US012279661B2

(12) United States Patent
First

(10) Patent No.: US 12,279,661 B2
(45) Date of Patent: Apr. 22, 2025

(54) THUMB-WORN PROTECTIVE BATTING AID FOR REDUCING TRANSMISSION OF VIBRATION AND IMPACT FROM THE BAT

(71) Applicant: Craig First, Concord, MA (US)

(72) Inventor: Craig First, Concord, MA (US)

(73) Assignee: THUMB-PER, INC., Concord, MA (US)

( * ) Notice: Subject to any disclaimer, the term of this patent is extended or adjusted under 35 U.S.C. 154(b) by 29 days.

(21) Appl. No.: 16/407,363

(22) Filed: May 9, 2019

(65) Prior Publication Data

US 2020/0352261 A1 Nov. 12, 2020

(51) Int. Cl.
*A41D 13/08* (2006.01)
*A63B 71/14* (2006.01)

(52) U.S. Cl.
CPC ..... *A41D 13/087* (2013.01); *A41D 13/082* (2013.01); *A63B 71/14* (2013.01)

(58) Field of Classification Search
CPC .... A41D 13/08; A41D 13/081; A41D 13/082; A41D 13/087; A63B 71/14; A63B 60/12; A63B 2069/0008; A63B 2209/00; A63B 2102/18
See application file for complete search history.

(56) References Cited

U.S. PATENT DOCUMENTS 3,066,306 A 12/1962 Thomas
3,496,573 A 2/1970 Kuchar et al.
3,890,648 A 6/1975 Beal
4,461,043 A * 7/1984 Lomedico ..... A63B 71/146 2/16
4,615,046 A 10/1986 Martin
4,617,684 A 10/1986 Green et al.
4,977,621 A 12/1990 Richard
(Continued)

FOREIGN PATENT DOCUMENTS

GB 2285910 A 2/1995

OTHER PUBLICATIONS

Website: https://www.eastbay.com/product/model:21478/sku:777100/prohitter-batting-aid/black/?SID=7726&inceptor=1&cm_mmc=SEM-_-PLA-_-Google-_-777100&gclid=Cj0KCQjwIK7cBRCnARIsAJiE3MhuZ7PAMRti8EEKJTo88K7bMhse63CSFv8pW2jXmXwMpunbLBLZX8saAsh8EALw_wcB&gclsrc=aw.ds Dowloaded Aug. 31, 2018 Prohitter Batting Aid.
(Continued)

*Primary Examiner* — Bao-Thieu L Nguyen
(74) *Attorney, Agent, or Firm* — Gottlieb, Rackman & Reisman, PC

(57) ABSTRACT

A batting aid to be worn on a thumb of a distal hand of a baseball player while gripping a handle of a baseball bat. The batting aid includes a thumb ring to secure the batting aid to the thumb, and a cushioning saddle integrated with the thumb ring. The saddle has a crest portion configured to engage a portion of the second metacarpal of the distal hand, also having at least one resiliently deformable flap configured to extend substantially along a middle portion of the second metacarpal bone of the distal hand. The batting aid minimizes the transmission of vibration and impact from the bat hitting a ball, thereby reducing pain and injury. The batting aid conforms to the bat handle and improves a player's grip on the bat. Because the resiliently deformable flap is self-aligning on the player's hand, the player can more easily concentrate on hitting pitched balls.

20 Claims, 5 Drawing Sheets

(56) References Cited

U.S. PATENT DOCUMENTS

| | | | | |
|---|---|---|---|---|
| 4,987,611 | A * | 1/1991 | Maye | A63B 71/143 2/19 |
| 5,069,454 | A * | 12/1991 | Frost | A63B 60/08 473/206 |
| 5,180,165 | A * | 1/1993 | Frost | A63B 60/10 473/206 |
| 5,257,418 | A | 11/1993 | Jaskiewicz | |
| 5,345,608 | A * | 9/1994 | Mergens | A41D 13/082 2/159 |
| 5,479,660 | A | 1/1996 | Najac | |
| D373,225 | S | 8/1996 | Theroux | |
| 5,604,934 | A | 2/1997 | Willett | |
| 5,768,704 | A | 6/1998 | Greenhalgh | |
| 5,806,091 | A | 9/1998 | McHugh | |
| 5,963,985 | A | 10/1999 | Behr et al. | |
| 6,260,198 | B1 * | 7/2001 | LoMedico | A41D 13/081 2/161.1 |
| 6,389,596 | B2 * | 5/2002 | LoMedico | A41D 13/081 2/161.1 |
| 6,427,246 | B1 | 8/2002 | Doi et al. | |
| 6,532,594 | B1 | 3/2003 | Barnett | |
| 6,839,905 | B1 | 1/2005 | Bruder et al. | |
| D552,302 | S | 10/2007 | Le Carpentier | |
| 7,377,566 | B2 * | 5/2008 | Gazaui | B65G 7/12 294/137 |
| 7,431,671 | B1 * | 10/2008 | Frost | A63B 69/0002 473/458 |
| D585,605 | S | 1/2009 | Kamradt | |
| 7,484,248 | B2 * | 2/2009 | Lomedico | A41D 13/081 2/20 |
| 7,572,210 | B2 | 8/2009 | Marinello | |
| 8,763,162 | B2 * | 7/2014 | LoMedico | A63B 71/14 2/20 |
| 8,852,033 | B1 * | 10/2014 | Frost | A63B 60/10 473/458 |
| 9,393,148 | B2 | 7/2016 | Greenberg et al. | |
| 9,549,579 | B2 | 1/2017 | Bailey | |
| 9,603,394 | B2 * | 3/2017 | LoMedico | A63B 71/14 |
| 9,899,012 | B2 * | 2/2018 | First | G10D 3/00 |
| 10,212,976 | B2 | 2/2019 | Bailey | |
| D843,589 | S | 3/2019 | Han | |
| 2001/0034889 | A1 * | 11/2001 | LoMedico | A41D 13/081 2/20 |
| 2005/0114985 | A1 | 6/2005 | Falone et al. | |
| 2009/0038159 | A1 * | 2/2009 | White | A41D 13/087 30/123 |
| 2009/0077706 | A1 * | 3/2009 | Prather | A41D 19/01588 2/21 |
| 2009/0313737 | A1 * | 12/2009 | Richard | A63B 71/14 2/20 |
| 2011/0265239 | A1 | 11/2011 | Kanemitsu et al. | |
| 2013/0254964 | A1 * | 10/2013 | Robinson | A41D 13/087 2/16 |
| 2013/0291273 | A1 * | 11/2013 | LoMedico | A41D 13/082 2/16 |
| 2016/0184042 | A1 * | 6/2016 | Buhari | A61B 42/20 2/21 |
| 2017/0106260 | A1 | 4/2017 | Akin | |
| 2017/0270901 | A1 * | 9/2017 | First | G10G 5/005 |
| 2017/0347727 | A1 * | 12/2017 | Bailey | A63B 71/143 |
| 2018/0221732 | A1 * | 8/2018 | Mangone | A63B 53/14 |

OTHER PUBLICATIONS

Website: https://www.anthem-sports.com/catalog/product/view/id/12235/?msclkid=95077e34e2531b073f5d25b971331e8e&utm_source=bing&utm_medium=cpc&utm_campaign=%5BADL%5D%20%5BPLA%5D%20Generic%20(High)&utm_term=4580359284357697&utm_content=Generic&adlclid=ADL-b6caa556-0515-4947-aaa6-bc356cd0a680 Downloaded Aug. 31, 2018 Evoshield Catcher's Thumb Guard.

Website: http://catchersthumb.com/ Downloaded Aug. 31, 2018 Catcher's Thumb The Catcher's Thumb was designed for baseball and softball catchers, but can be worn by any player who has, or wants to prevent, a thumb injury.

Website: https://www.ebay.com/itm/263619545621 Downloaded Aug. 31, 2018 Franklin Sports MLB Shok-Sorb Sting Reducer Easily attaches to thumb for a comfort fit, provides improved bat grip and sting reducer, anti-vibration.

Website: https://www.kochsports.com/evoshieldprotectivehourglassmultiformatguard.aspx Downloaded Aug. 31, 2018 EvoShield Protective Hourglass Multiformat Guard Custom-molding pad begins soft and flexible, transforming into a hard and protective Shield in minutes. EvoShield's custom-molding Hourglass Guard provides protection where you need it—whether it's your thumb, fingers or palm.

Website: https://www.amazon.com/Louisville-Slugger-Blaze-Power-Grip/dp/B077FHTT33/ref=sr_1_tkmr0_1?ie=UTF8&qid=1536050866&sr=8-1-fkmr0&keywords=rubber+batting+aid+thumb Downloaded Aug. 31, 2018 Louisville Slugger Blaze Power Grip Gets the bat handle out towards the fingertips leading to increased bat speed and power. Unique thumb and finger loops for better grip and is made of durable high Density rubber.

Website: https://www.betterbaseball.com/shock-stop-palm-pad-adult.html Downloaded Aug. 31, 2018 Shock Stop Palm Pad Adult The STS glove from Palmguard provides great protection as a batting glove or underglove. 'Shock Transfer System' padding protects the heel of the palm, thumb and finger gripping areas.

Website: https://baseball.epicsports.com/prod/10284/index.html Downloaded Aug. 31, 2018 Direct Protect Baseball Bat Grips Prevents batting sting.

Website: http://vi.vipr.ebaydesc.com/ws/eBayISAPI.dll?ViewItemDescV4&item=200625108999&t=1309760547000&tid=10&category=159062&seller=ideesports2010&excSoj=1&excTrk=1&Isite=0&ittenable=false&domain=ebay.ca&descgauge=1&cspheader=1&oneClk=1&secureDesc=0 Downloaded Aug. 31, 2018 Baseball Thumb Protector.

Website: http://sluggertraining.com/shop/featured/blaze-power-grip-2/ Downloaded Jun. 20, 2019 Blaze Power Grip The overall design of the Blaze Power Grip surrounds the bat and completely covers the palm leading to elimination of the sting and a drastic reduction in injuries associated with repetition training and hitting.

Amazon, "Prohitter Batters Training Aid," first available Nov. 10, 2010; www.amazon.com/dp/B009KKWSXS/.

* cited by examiner

THUMB-WORN PROTECTIVE BATTING AID FOR REDUCING TRANSMISSION OF VIBRATION AND IMPACT FROM THE BAT

FIELD OF THE INVENTION

This invention relates generally to sports safety equipment, and more particularly to hand-protection equipment for batting sports.

BACKGROUND OF THE INVENTION

Many sports require the use of a bat or a stick, including for example baseball, softball, ice hockey, field hockey, and cricket. Today, many sports players use safety equipment to protect their hands during play with bats and sticks. For example, ice hockey players typically use gloves while playing, and baseball batters commonly wear gloves to protect their hands while holding a bat.

In baseball, when a player swings a bat, and the bat hits a pitched ball, sometimes vibration is transmitted from the bat to the player's hands that can be quite severe. This vibration can cause what is commonly called "bat sting".

In professional baseball, the average speed of a pitched baseball is approximately 90 MPH, and typical pitched ball speeds range from 80 MPH to 100 MPH, with some pitchers consistently pitching over 100 MPH. The resulting instantaneous peak impact of the ball striking the swinging bat can reach 5,000 to 10,000 pounds of force.

When a bat hits a ball, vibrations are transmitted from the impact site down the shaft of the bat to the player's hands. These vibrations are caused by bending modes of the bat. Using high speed photography, vibration modes of a bat have been measured and studied.

Ideally, the player attempts to hit the ball within a "sweet spot" of the bat. The "sweet spot" is the location on the bat where bat vibrations are minimized, and therefore is where on the bat to hit the ball so that "bat sting" is minimized. If the ball hits the bat outside the area of the "sweet spot", the bending modes of the bat can be severe, and strong vibrations are transmitted to the player's hands. Bat sting can cause pain in the player's hands and can also result in bruising and injury to the player's hands. The hand most affected by bat vibrations is the "distal" hand, the distal hand being the hand that is closest to the point of contact between the ball and the bat. For a right handed batter, the distal hand would be the batter's right hand.

Bat sting can be so painful as to interfere with both the player's concentration and confidence, and therefore can interfere with the player's batting performance. Therefore, players attempt to hit the ball within the sweet spot of the bat as often as possible.

Because bat sting can cause injury to the player's hands, and is detrimental to batting performance, various ways to reduce vibrational shock to a batter's hands have been proposed.

One example is a cushioning pad made to be held between the batter's hand and the bat, as taught in Lomedico, U.S. Pat. No. 9,603,394 B2. In particular, Lomedico teaches a batting pad made from a cushioning material to be placed in the batter's palm area, also having a ring portion adapted to fit over a batter's thumb. However, the pad and ring portions can unintentionally pivot around the thumb of the batter, and therefore the cushioning pad of Lomedico can be oriented at any angle with respect to the thumb, reducing the effectiveness of the device. The need to carefully and repeatedly verify and adjust the cushioning pad of Lomedico so that it is correctly placed within the palm area of the hand can be distracting to the batter as the batter prepares to hit an incoming ball.

SUMMARY OF THE INVENTION

The batting aid of the invention provides a protective resiliently deformable flap that cushions a portion of the palm of the distal hand of a batter. The protective resiliently deformable flap minimizes the transmission of vibration and impact from the bat so as to reduce pain and injury from bat sting.

The batting aid of the invention also conforms to the handle of the bat to improve the player's grip on the bat. In some embodiments, the protective resiliently deformable flap can provide enhanced friction between the batting aid and the shaft of the bat. In addition, the protective resiliently deformable flap aides in positioning the metacarpals (bones located within the hand) away from the shaft of the bat, which can provide improved control of the bat by giving the proximal phalanges of the player's fingers a "lighter touch". This enhanced "lighter touch" can provide more precise finger control of the bat angle, can provide greater wrist flexibility, and can provide enhanced bat swinging mechanics.

The batting aid of the invention is conveniently secured to the thumb of the player's distal hand by way of a thumb ring that forms a thumbhole through which the thumb is inserted. The thumb ring is coupled to a saddle of the batting aid, which includes a crest portion and at least one resiliently deformable flap that extends from the crest portion to overlay at least a portion of the thenar space on the palmar side of the batter's distal hand, and to self-align the crest portion in an optimal position to straddle the first web space of the hand. Because the saddle of the batting aid is self-aligning, the batter does not have to take time to reposition the batting aid, and therefore the batter can more easily concentrate on hitting pitched balls.

A general aspect of the invention is a batting aid to be worn on a thumb of a distal hand of a baseball player while gripping a handle of a bat with both a proximal hand and the distal hand, the batting aid minimizing transmission of vibration and impact from the bat so as to reduce pain and injury, the batting aid also improving a player's grip on the bat. The batting aid includes: a thumb ring defining a thumbhole for receiving the thumb of the distal hand, the thumb ring being configured to substantially surround a proximal phalanx of the thumb of the distal hand to secure the thumb ring to the proximal phalanx of the thumb of the player's distal hand; and a saddle integrated with and projecting from the thumb ring, The saddle includes a crest portion configured to align with and substantially straddle the first web space of the distal had and extend from the ring to a conforming portion of an external distal boundary of the saddle. A concave portion of an internal surface as defined by the conforming portion of the external distal boundary is configured to engage a distal portion of the second metacarpal bone of the distal hand; and at least one resiliently deformable flap, the resiliently deformable flap configured to extend from the crest portion along the palmar side of the distal hand to overlay at least a portion of the thenar space of the distal hand, the distal end of the saddle being configured to extend substantially along a middle portion of the second metacarpal bone of the distal hand.

In some embodiments, the resiliently deformable flap has an outer surface that includes a concave surface configured so as to substantially conform to a portion of the handle of the bat when the player grips the handle of the bat.

In some embodiments, the concave surface is an elliptical concave surface.

In some embodiments, the thumb ring and the saddle are made from a resiliently deformable material selected from a group including: injectable rubber, Sorbothane®, silicone rubber, and silicone.

In some embodiments, the saddle is configured so as to act as a cushion that absorbs vibration and impacts from the handle of the bat.

In some embodiments, the resiliently deformable flap is made of a material that provides enhanced friction where the resiliently deformable flap and handle of the bat make contact while the handle of the bat is held.

In some embodiments, the resiliently deformable flap includes an enhanced-friction surface that provides enhanced friction where the resiliently deformable flap and handle of the bat make contact while the handle of the bat is held.

In some embodiments, the saddle further includes: a second resiliently deformable flap extending in bilaterally symmetric relationship with the first resiliently deformable flap.

In some embodiments, the saddle further includes: a second resiliently deformable flap extending less than the first resiliently deformable flap.

In some embodiments, an inner surface of the saddle together with an inner surface of the thumb ring are configured to engage and substantially span a generally V-shaped region formed between the thumb and a confronting side of the second metacarpal of the distal hand.

In some embodiments, the crest portion of the saddle substantially spans a region between the distal end of the proximal phalanx of the thumb and the distal end of the second metacarpal bone of the distal hand.

In some embodiments, the resiliently deformable flap of the saddle is configured such that when the distal hand grips the bat, the bat is biased in the distal hand so as to be angled forward towards the fingers of the distal hand.

BRIEF DESCRIPTION OF THE DRAWINGS

Many additional features and advantages will become apparent to those skilled in the art upon reading the following description, when considered in conjunction with the accompanying figures, wherein.

DETAILED DESCRIPTION

Figure 1A:
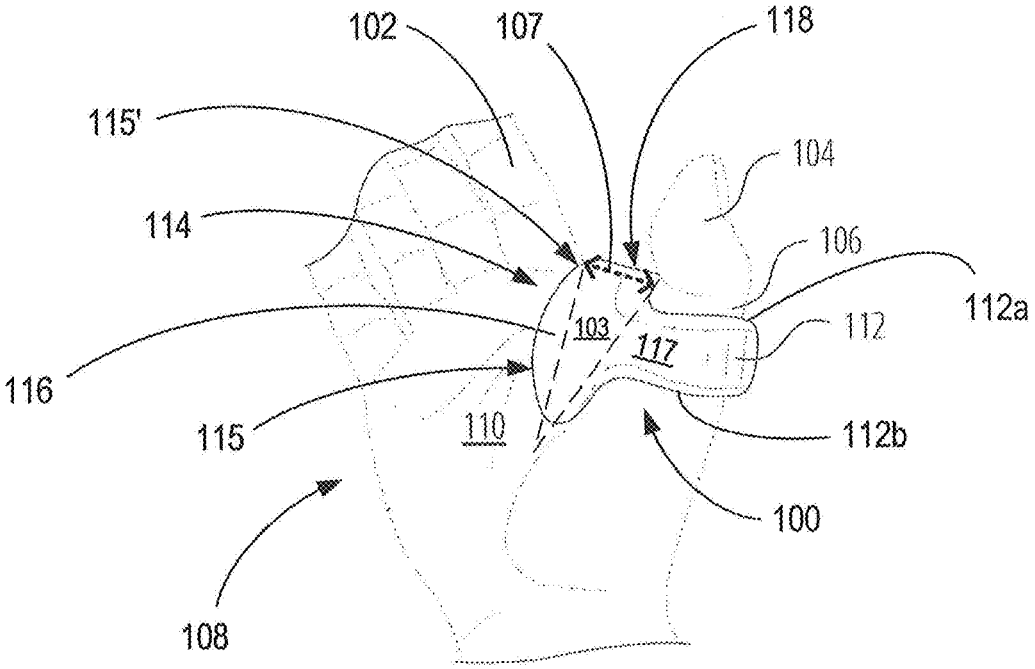
FIG. 1A is a perspective side view of an embodiment of a batting aid worn on a thumb and first web space of a distal hand, showing the thumb ring and the saddle, the crest portion of the saddle, which straddles the first web space of the distal hand, and one resiliently deformable flap of the saddle extending downwardly from the crest portion to overlay at least a portion of the thenar space of the distal hand.

With reference to FIG. 1A, a perspective view of a batting aid 100 worn on a thumb 104 and over the first web space (hidden from view but which is aligned with a length indicated by double arrow 107) of a distal hand 108 as is shown. The batting aid 100 includes a thumb ring 112 forming a thumb opening (119, FIGS. 2A-C) through which the thumb of the distal hand is inserted so that it fits over the proximal phalanx 106 of the thumb 104 to secure the batting aid 100 to the thumb 104 of the distal hand 108. Also shown is a saddle 114, which includes a crest portion 118 flanked by two resiliently deformable flaps 116 each extending downwardly from one or the other descending surface 117*a* of the crest portion 118 (only one flap 116 shown). The resiliently deformable flap 116 is positioned against a palm 110 of the distal hand 108 to overlay at least a portion of the thenar 103 space thereof.

As is illustrated by FIGS. 2A-D, saddle portion 114 includes an inner surface 113. Portions 113*a* and 113*c* (See FIG. 2D) of inner surface 113 underlies the crest portion 118. Inner surface 113 further extends to portion 113*b* the two contoured flaps 116. The inner surface portion 113*a* accommodates and rests upon at least a portion of the first web space of the distal hand 108 while being worn by the user, and portion 113*c* of inner surface 113 makes securing contact against the second metacarpal bone of the distal hand when gripping a bat handle. The saddle 114 also includes an outer surface 117, which joins with the inner surface 113 to define an external distal boundary 115 of the saddle. The external distal boundary 115 defines the extremities of the saddle 114, which includes boundaries of the deformable flaps 116 and the crest portion 118. The external distal boundary 115 includes a conforming portion 115' that defines a concave shaped boundary at the distal end of the crest portion 118, where a portion 117*c* of the outer surface 117 of the crest portion 118 meets a concave portion 113*c* of the inner surface 113 spanning between the flaps 116.

Figure 4A:
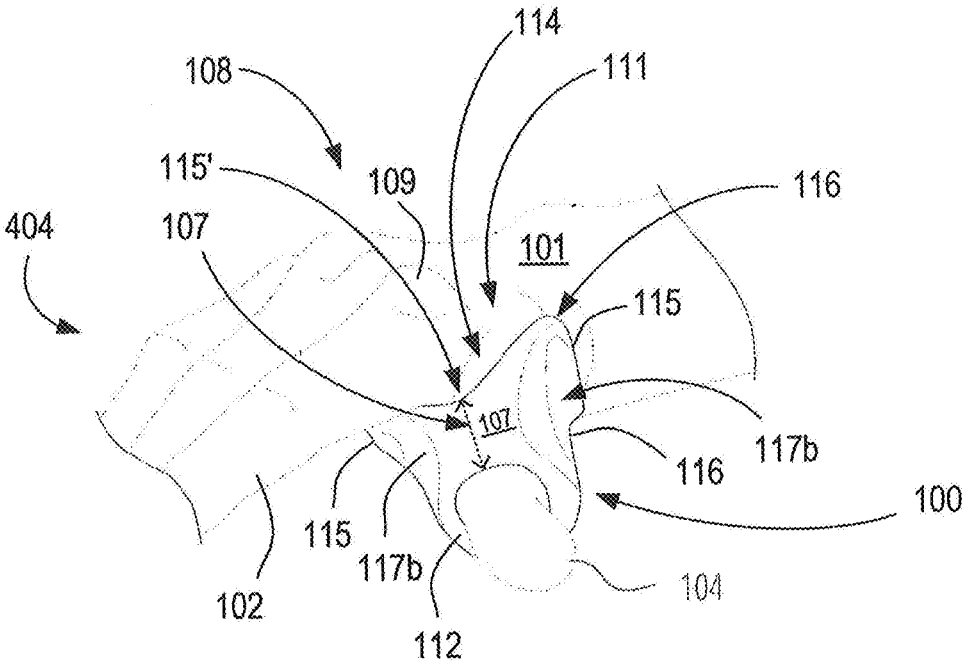
FIG. 4A is a perspective top view of the batting aid worn secured to the thumb and over the first web space of the distal hand, showing the thumb ring and the saddle, including the crest portion and two resiliently deformable flaps, also showing the fingers of the distal hand in an open position.
Figure 4B:
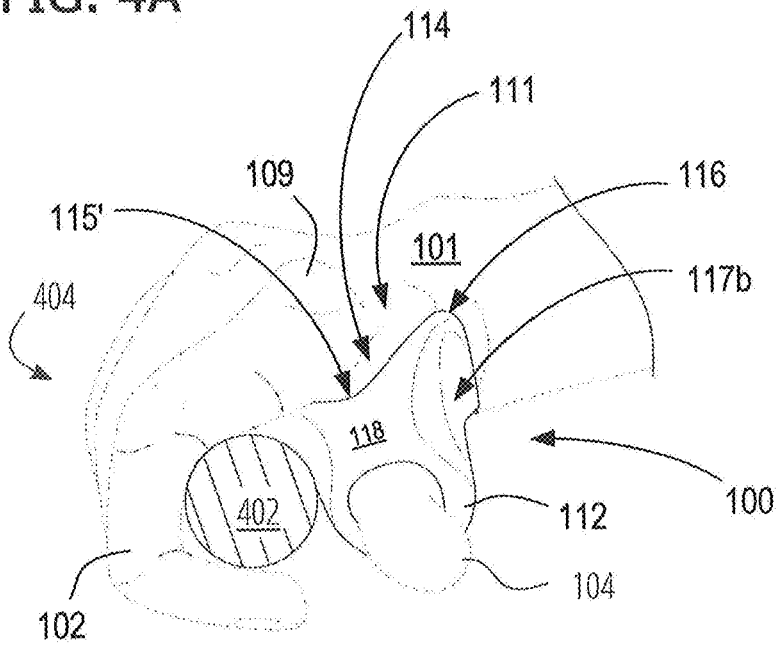
FIG. 4B is a perspective top view of the batting aid of FIG. 4A worn secured to the thumb and over the first web space of the distal hand, showing the fingers of the distal hand in a closed position so as to grip the bat handle, also showing one of the two resiliently deformable flaps positioned between the bat handle and a portion of the thenar space on the palmar side of the player's distal hand.

With reference to FIG. 4A, when the batting aid 100 is worn by a user, the crest portion 118 extends distally from the proximal phalanx 106 of the thumb 104 towards the second metacarpal bone 111 of the distal hand 108. When the distal hand is not gripping the bat handle, the distance between the proximal phalanx 106 of the thumb 104 and the portion 113*c* of inner surface 113 defined by the conforming portion 115' of the external distal boundary 115 of the saddle 114 can be greater than the length 107. When the distal hand 108 grips the bat handle as shown in FIG. 4B, however, the muscles and tendons of the distal hand 108 will inherently pull the proximal phalanx 106 of the thumb 104 and the concave portion 113*c* of inner surface 113 towards one another to generate gripping force therebetween. Thus, as the distance therebetween becomes equal to the length 107, portion 113*c* engages with the proximal phalanx and the batting aid 100 becomes secured in its operable position, while being aligned with, and substantially spanning the length of, the first web space of the distal hand 108.

The portion 113*c* of inner surface 113 as defined by the conforming portion 115' is concave in shape and is thereby configured to engage with the second metacarpal bone 111 of the distal hand 108 at a location at or below the second metacarpophalangeal (MCP) joint (109, FIGS. 4A, B). MCP 109 is the joint through which the distal end of the second metacarpal bone 111 is coupled to the proximal phalange 106 of the index finger 102.

Figure 1B:
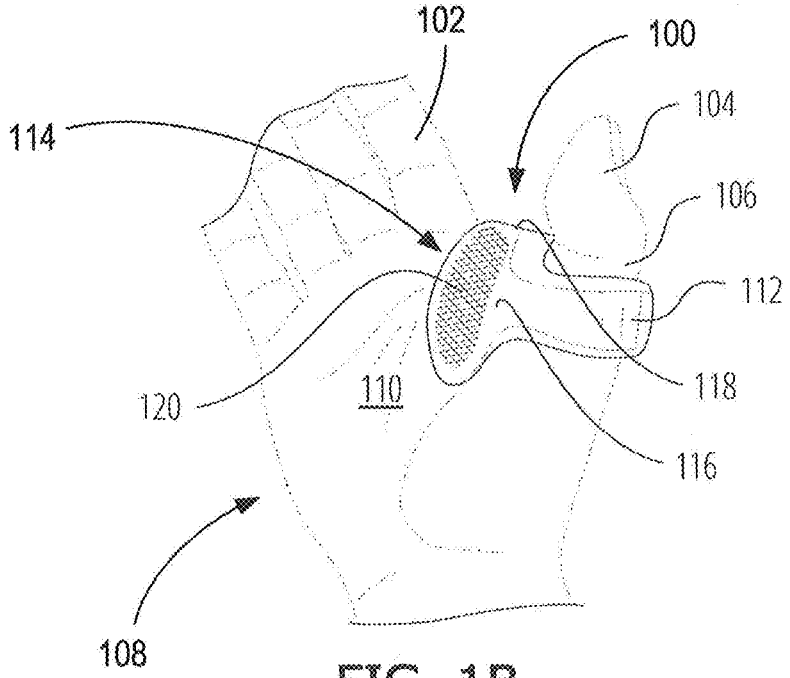
FIG. 1B is a perspective side view of the batting aid of FIG. 1A, further including an enhanced-friction surface on the resiliently deformable flap of the saddle.

With reference to FIG. 1B, a perspective view of the batting aid 100 of FIG. 1A worn on the thumb 104 of the distal hand 108 is shown. Shown is an alternate embodiment of the batting aid 100 wherein the portion 117*b* of outer surface 117 provides having an enhanced-friction surface 120 on the resiliently deformable flap 116 of the saddle 114, the enhanced-friction surface 120 configured to improve the grip of the distal hand 108 on the bat handle (402, FIGS. 4B, 5A, 5B). The resiliently deformable flap 116 is positioned against the palm 110 located on the palmer side of the distal hand 108, and overlays at least a portion of the thenar space 103 thereof. The resiliently deformable flap 116 is configured to conform to the shape of a bat handle 402 when gripped by the distal hand 108 (shown in FIG. 4B).

In some embodiments, the portion 117*b* of outer surface 117 that covers resiliently deformable flaps 116 is made of a material that provides enhanced friction, where one of the resiliently deformable flaps 116 and the bat handle 402 make contact while the bat handle 402 is gripped.

In some embodiments, the portions 117*d* of the outer surface 117 shared by the resiliently deformable flaps 116 have a concave surface 117*b* configured so as to substantially conform to the bat handle 402 when the distal hand 108 grips the bat handle 402. In some embodiments, the resiliently deformable flaps 116 each have a concave surface 117*b* that is elliptical in shape.

In some embodiments, the saddle 114 is configured so as to act as a cushion that absorbs vibration and impacts from the bat handle 402.

In some embodiments, the thumb ring 112 and the saddle 114 are made from a resiliently deformable material selected from a group including: injectable rubber, Sorbothane®, silicone rubber, and silicone.

Figure 2A:
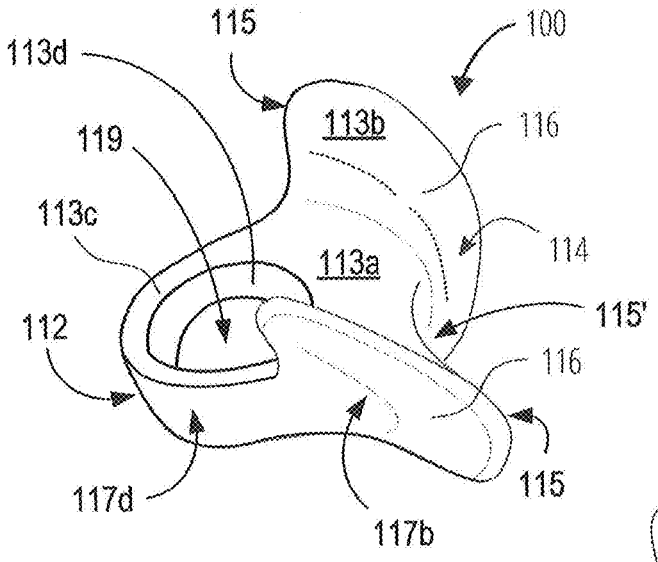
FIG. 2A is a rotated side perspective view of the underside of the batting aid opposite the crest portion and showing the thumb ring and the saddle, the saddle including two resiliently deformable flaps extending from the crest portion and a supporting portion of an inner surface underlying the crest portion to accommodate contact with a portion of the web spacing.

With reference to FIG. 2A, a perspective view of the underside of the batting aid 100 is shown, showing the thumb ring 112 and the saddle 114 having two resiliently deformable flaps 116. In this embodiment, the two resiliently deformable flaps 116 extend in a bilaterally symmetric relationship with each other from crest portion 118 that is not visible from this view. The portion 113*a* of inner surface 113 receives a portion of the first web space of distal hand 108 when the batting aid 100 is worn by the user.

In some embodiments, the two resiliently deformable flaps 116 extend unequally.

In this embodiment, the portion 113*a* of inner surface 113 of the saddle 114 spans between the resiliently deformable flaps 116 and the underside of crest portion 118 by which the batting aid 100 rests upon the skin of the user's first web space (under the crest portion 118), engages with the second metacarpal 111 (at the conforming portion 115' of the external distal boundary 115) and the thenar space 103 on the palmer and dorsal sides of the distal hand (under the palmer and dorsal deformable flaps 116). The portion 113*a* of inner surface 113 is also shared with the underside of a distal portion of the thumb ring 112 (See FIG. 2A) and is configured to engage with at least a portion of the first web space. Portion 113*b* of inner surface 113 is configured to overlay a generally V-shaped region known generally as the thenar space 103. The crest portion 118 extends axially along length 107 from thumb 104 (shown in FIG. 1A) to a confronting side of the second metacarpal 111 of the distal hand 108 (both shown in FIG. 1A) to substantially span the first web space of the distal hand 8 when gripping a bat handle.

Figure 2B:
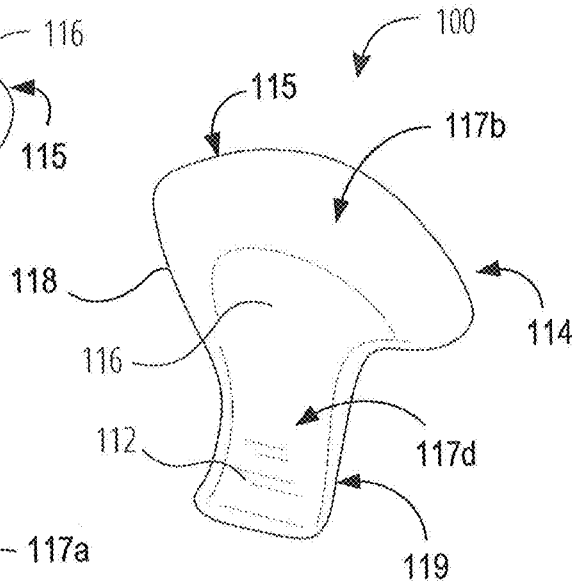
FIG. 2B is a rotated side view of the batting aid of FIG. 2A showing the thumb ring and the saddle, including the crest portion that connects the thumb ring and the saddle, and one resiliently deformable flap of the saddle.

With reference to FIG. 2B, a side view of the batting aid 100 of FIG. 2A is shown, showing the thumb ring 112 and the saddle 114, including the crest portion 118, and showing one of two resiliently deformable flaps 116.

Figure 2C:
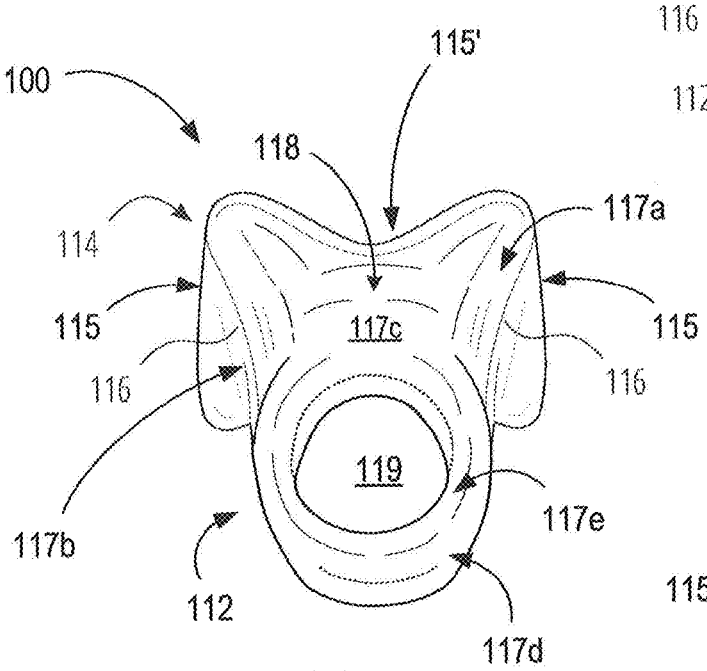
FIG. 2C is a perspective view, rotated away from the viewer, of the top of the batting aid of FIG. 2A showing the thumb ring and the saddle, including the crest portion that is distally bounded by a conforming portion of an external distal boundary of the saddle that the crest portion shares with the two resiliently deformable flaps of the saddle.
Figure 2D:
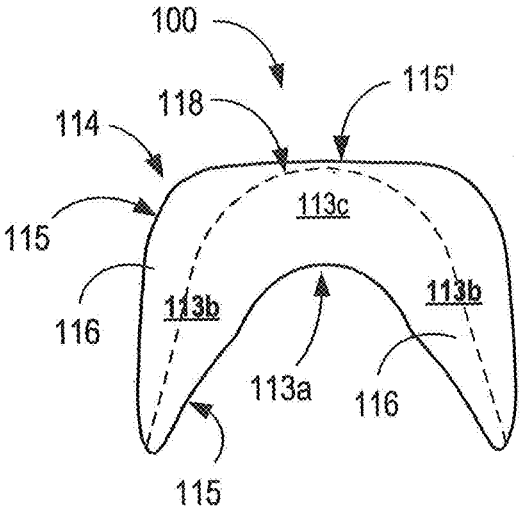
FIG. 2D is a view of the distal end of the batting aid opposite to that of view of FIG. 2C (the thumb ring being obscured by the saddle), showing the internal outline of the convex crest portion, and the external distal boundary of the saddle including a concave conforming portion of the external distal boundary that distally defines the crest portion as well as a concave portion of the inner surface that is configured to engage with a distal portion of the second metacarpal bone of the distal hand when gripping the handle of a bat.

With reference to FIG. 2C, a top view of the batting aid 100 of FIG. 2A is shown, showing the thumb ring 112 and the saddle 114. The saddle 114 consists of two descending resiliently deformable flaps 116 joined by the crest portion 118 at descending portions 117*a* of outer surface 117. The thumb ring 112 is connected to the resiliently deformable flaps 116 and the crest portion 118 of the saddle 114. The concave shaped surface 117*b* of one flap 116 is also shown extending to a portion of the descending outer surface 117*a* of the crest portion 118, along with external distal boundary 115 that defines the extremities of the flaps 116 of saddle 114, as well as a conforming portion 115' that defines the distal extremity of the crest portion 118. It can also be seen that, for an embodiment where the thumb ring 112 and the saddle 114 are integrated, a proximal portion of outer surface 117*c* is commonly shared between the crest portion 118 and a distal top surface 117*e*, and an outer ring surface 117*d* of the thumb ring 112.

Figure 3:
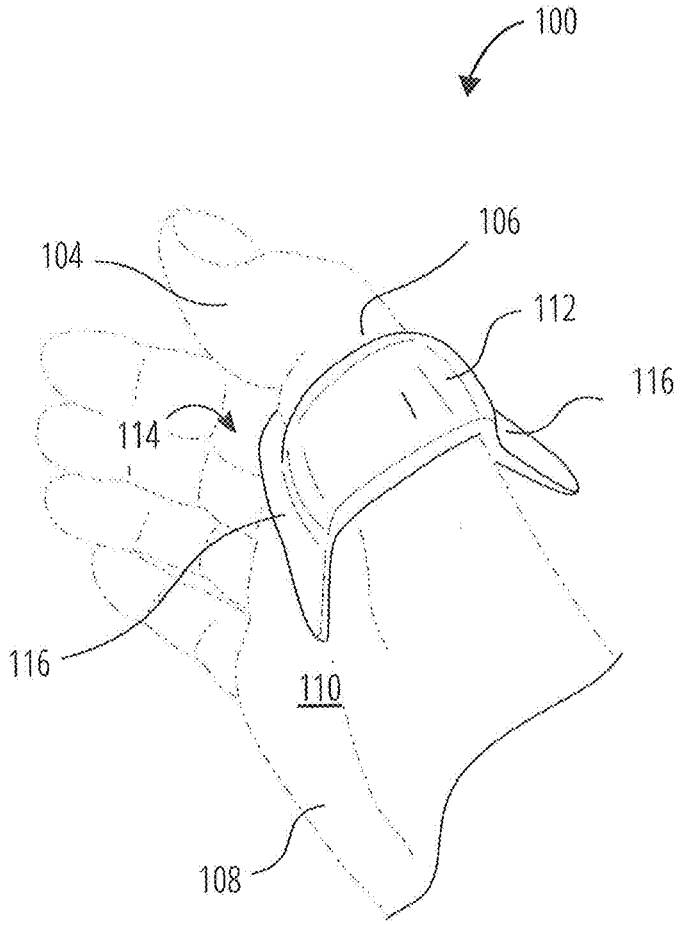
FIG. 3 is a perspective front view of the batting aid of FIG. 1 worn secured to the thumb and over the first web space of the distal hand, showing the thumb ring and the two resiliently deformable flaps that self-align the crest portion along the first web space of the distal hand by overlaying the thenar space on the palmar and dorsal sides of the player's distal hand.

With reference to FIG. 3, a perspective front view of the batting aid 100 worn on the thumb 104 of the distal hand 108 is shown. The thumb ring 112 fits over the proximal phalanx 106 of the thumb 104 of the distal hand 108. The saddle 114 includes two resiliently deformable flaps 116, and one of the two resiliently deformable flaps 116 is positioned against the palm 110 of the distal hand 108.

Because the two resiliently deformable flaps 116 are self-aligning with the distal hand 108, the batter does not have to spend time aligning the batting aid 100, and the batter can therefore concentrate on hitting pitched balls.

With reference to FIG. 4A, a perspective top view of the batting aid 100 worn on the thumb 104 of the distal hand 108 is shown. Also shown is the thumb ring 112 and the saddle 114, the saddle 114 including the crest portion 118 and two resiliently deformable flaps 116. The resiliently deformable flaps 116 are self-aligning with the palmar and dorsal 101 sides of the hand to align the crest portion 118 over the first web space of the distal hand 108. The fingers 404 of the distal hand 108 are shown in an open position.

In this embodiment, the crest portion 118 of the saddle 114 substantially spans a length 107 over the first web space, a region that lies between the distal end of the proximal phalanx of the thumb 104 and the distal end of the second metacarpal bone 111 of the distal hand 108. The concave conforming portion 115' of the external distal boundary 115 of the saddle 114 defines a concave portion 113*c* (FIG. 2D) of the inner surface 113 that receives the second metacarpal 111 of the distal hand 108, at or just below the second MCP joint 109.

With reference to FIG. 4B, a perspective top view of the batting aid 100 worn on the thumb 104 of the distal hand 108 is shown. Also shown is the thumb ring 112 and the saddle 114, the saddle 114 including the crest portion 118 and two resiliently deformable flaps 116 that extend from each side of the crest portion to overly at least a portion of the thenar space 103 on both the palmar (not shown) and dorsal 101 sides of the distal hand 108. The fingers 404 of the distal hand 108 are in a closed position so as to grip the bat handle 402.

One resiliently deformable flap 116 of the saddle 114 is captured between the bat handle 402 and the palm 110 (shown in FIG. 1A) of the player's distal hand 108. This resiliently deformable flap 116 conforms to the bat handle 402 and improves the grip of the distal hand 108 on the bat handle 402.

Figure 5A:
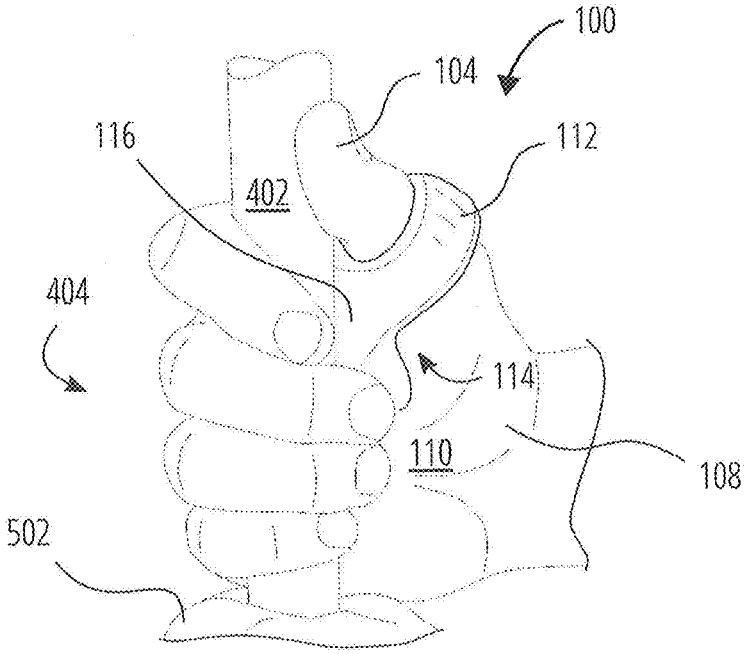
FIG. 5A is a perspective side view of the batting aid worn secured to the thumb and over the first web space of the distal hand, showing the bat handle gripped by both the distal hand and the proximal hand, also showing the thumb ring and a resiliently deformable flap of the saddle, having the fingers of the distal hand in a closed position so as to grip the bat handle, having one resiliently deformable flap of the saddle pressed between the bat handle and a portion of the thenar space on the palmar side of the player's distal hand.

With reference to FIG. 5A, a perspective view of the batting aid 100 worn on the thumb 104 of the distal hand 108 is shown. The bat handle 402 is gripped by the both the distal hand 108 and the proximal hand 502, and the fingers 404 of the distal hand 108 are in a closed position so as to grip the bat handle 402.

Also shown are the thumb ring 112 and the saddle 114. One of the two resiliently deformable flaps 116 of the saddle 114 is pressed between the bat handle 402 and the palm 110 of the player's distal hand 108.

The resiliently deformable flap 116 captured between the bat handle 402 and the palm 110 of the player's distal hand 108 cushions the vibrations and impact from the bat handle 402 as the bat hits a pitched ball, protecting the player from pain and injury.

Figure 5B:
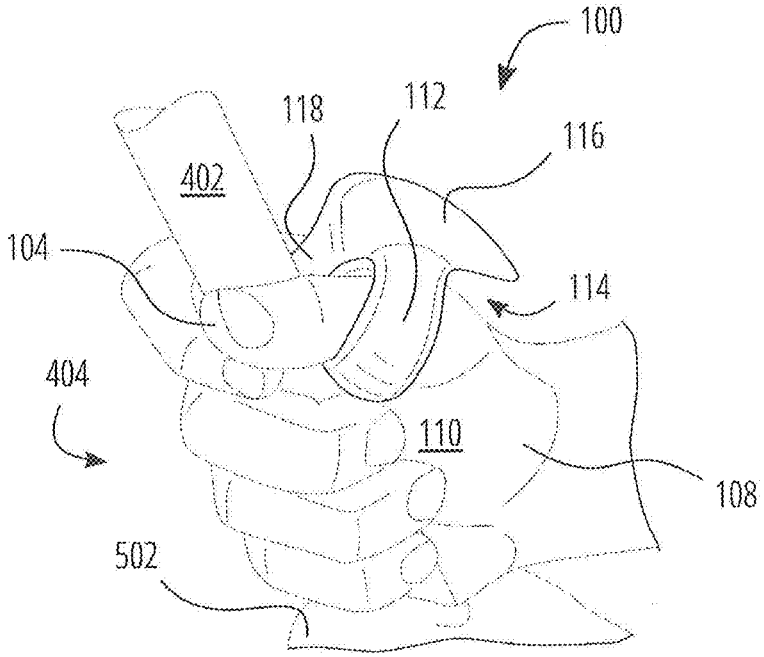
FIG. 5B is a perspective front view of the batting aid worn secured to the thumb and over the first web space of the distal hand, showing the bat handle gripped by both the distal hand and the proximal hand, also showing the thumb ring, the crest of the saddle, and a second resiliently deformable flap, while the fingers of the distal hand are closed in a grip around the bat handle, the first resiliently deformable flap being hidden between the bat handle and a portion the thenar space on the palmar side of the player's distal hand.

With reference to FIG. 5B, a perspective view of the batting aid 100 worn on the thumb 104 of the distal hand 108 is shown. The bat handle 402 is gripped by the both the distal hand 108 and the proximal hand 502, and the fingers 404 of the distal hand 108 are in a closed position so as to grip the bat handle 402.

Also shown are the thumb ring 112 and the saddle 114, the saddle 114 including the crest portion 118 and a second one of two resiliently deformable flaps 116, the second resiliently deformable flap 116 shown extending away from the bat handle 402. The other flap of the two resiliently deformable flaps 116 (hidden in this view) is captured between the bat handle 402 and the palm 110 of the player's distal hand 108.

In this embodiment, both the resiliently deformable flaps 116 are self-aligning with the distal hand 108, and therefore the batter does not have to spend time aligning the batting aid 100, and the batter can therefore concentrate on hitting pitched balls.

In this embodiment, the resiliently deformable flap 116 (hidden in this view) pressed into contact with the bat handle 402 is configured such that when the distal hand 108 grips the bat handle 402, the bat handle 402 is biased in the distal hand 108 so as to be angled forward towards the fingers 404 of the distal hand 108.

Other modifications and implementations will occur to those skilled in the art without departing from the spirit and the scope of the invention as claimed. Accordingly, the above description is not intended to limit the invention, except as indicated in the following claims.

What is claimed is:

1. A thumb guard configured to be arranged over a thumb of a hand of a user to protect against vibration, the thumb guard comprising:

a thumb ring having a sidewall with an external surface, an internal surface that is spaced from the external surface, an upper surface extending between the external surface and the internal surface at a first end of the sidewall and a lower surface extending between the external surface and the internal surface at a second end of the sidewall, the internal surface defining an opening that is configured to receive and substantially surround a proximal phalanx of the thumb of the hand to secure the thumb guard to the hand, the upper surface extending substantially uniformly about the thumb ring between the external surface and the internal surface; and a saddle integrated with and extending directly from the thumb ring, the saddle extending beyond the upper surface of the thumb ring, the saddle and the thumb ring comprised of resiliently deformable material, and the saddle including a first flap extending from a first side of the saddle beyond the lower surface of the thumb ring, a second flap that is spaced from the first flap and extending from a second side of the saddle beyond the lower surface of the thumb ring, the saddle including a first surface extending from the thumb ring and a second surface extending from the thumb ring in a same direction as the first surface with the first surface and the second surface converging to define an outer periphery of the saddle, a portion of the outer periphery of the saddle extending concavely between the first flap and the second flap in a direction toward the thumb ring as viewed from the outer periphery of the saddle between the first flap and the second flap toward the thumb ring such that when the thumb ring is arranged on the thumb of the hand while gripping an object, the saddle directly bridges a distance between the proximal phalanx of the thumb with the outer periphery of the saddle configured to engage with a portion of a second metacarpal bone at the portion of the saddle that extends concavely between the first flap and the second flap to establish and maintain an operative relationship between the thumb guard and to the hand and absorb vibration, the second surface of the saddle extending concavely between the first flap and the second flap, and the first flap and the second flap extending bilaterally symmetrical with respect to each other from the saddle with the first flap, when worn by the user, configured to cover a substantial portion of a thenar space on the palmar side of the hand and the second flap configured to extend from the saddle and cover a portion of a dorsal side of the hand.

2. The thumb guard of claim 1, wherein the saddle has a crest portion and the first flap and the second flap extend to at least part of a descending portion of the crest portion.

3. The thumb guard of claim 2, wherein the first flap and the second flap extend elliptically as viewed from the outer surface of the saddle.

4. The thumb guard of claim 1, wherein the thumb guard is made from a viscoelastic polymer.

5. The thumb guard of claim 1, wherein the saddle is configured to cushion the thenar space of the hand.

6. The thumb guard of claim 1, wherein the first flap and the second flap include a material that is configured to provide enhanced friction.

7. The thumb guard of claim 1, wherein the saddle included a crest portion and, when the thumb guard is in the operative relationship with the hand, the crest portion of the saddle is configured to span a length between a distal end of the proximal phalanx of the thumb and a distal end of the second metacarpal bone of the hand to cover a first web space of the hand.

8. The thumb guard of claim 1, wherein the saddle has a crest portion and the crest portion and the first flap of the saddle are jointly configured to bias—the object toward fingers of the hand when gripping the bat object.

9. The thumb guard of claim 1, wherein when the batting aid is in the operative relationship with the hand of the user the second flap covers a portion of the thenar space of a second one of the hands of the user when used as the hand, and the second flap includes a concave shape configured to receive and accommodate a portion of the object.

10. A thumb guard configured to be arranged over a thumb of a hand of a user to protect against vibration, the thumb guard comprising:

a thumb ring having a sidewall with an external surface, an internal surface that is spaced from the external surface, an upper surface extending between the external surface and the internal surface at a first end of the sidewall and a lower surface extending between the external surface and the internal surface at a second end of the sidewall, the internal surface defining an opening that is configured to receive and substantially surround a proximal phalanx of the thumb of the hand to secure the thumb guard to the hand; and a saddle coupled to and extending directly from to the thumb ring, the saddle extending beyond the upper surface of the thumb ring, the saddle including an outer surface and an inner surface that is spaced from the outer surface extending from the thumb ring in a same direction with the outer surface and the inner surface converging to define an outer periphery of the saddle, the outer periphery of the saddle extending concavely at the distal boundary in a direction toward the thumb ring as viewed from the outer periphery of the saddle toward the thumb ring such that when the thumb guard is arranged on the thumb of the hand while gripping an object, the saddle directly bridges a distance between the proximal phalanx of the thumb and a second metacarpal bone, the distal end that extends concavely being configured to engage with a portion of the second metacarpal bone to establish and maintain an operative relationship between the thumb guard and the hand and absorb vibration, the saddle including a first flap is resiliently deformable when the thumb guard is worn by the user that and extends beyond the lower surface of the thumb ring, the first flap configured, when worn by the user, to cover a substantial portion of a thenar space on a palmer side of the hand.

11. The thumb guard of claim 10, wherein when the thumb guard is in the operative relationship with the hand, the saddle covers first web space of the hand.

12. The thumb guard of claim 10, wherein the first flap is configured to deform under gripping forces produced while gripping the object.

13. The batting aid-thumb guard of claim 12, wherein deformation of the first flap is concave in shape and extends to at least part of a descending portion of the saddle.

14. The thumb guard of claim 10, wherein the thumb guard is made of a viscoelastic polymer.

15. The thumb guard of claim 10, further comprising a second flap that is resiliently deformable and configured to extend from the saddle the on a dorsal side of the hand.

16. The thumb guard of claim 15, wherein the second flap covers a substantial portion of the thenar space of a second one of the hands of the user when used as the hand while in the operative relationship with the hand.

17. The thumb guard of claim 10, wherein the thumb ring is integrated with the saddle such that the outer surface of the saddle is in communication with the upper surface and the outer surface of the sidewall of the thumb ring, and the second surface of the saddle is in communication with the lower surface and the inner surface of the sidewall of the thumb ring.

18. The thumb guard of claim 16, wherein a portion of the thumb ring is coincident with a proximal end of the saddle.

19. The thumb guard of claim 1, wherein an outer periphery of the first flap and an outer periphery of the second flap extend from the thumb ring in a curved manner.

20. The thumb guard of claim 1, wherein the upper surface of the thumb ring extends substantially uniformly about the thumb ring between the external surface and the internal surface.

* * * * *